US005147012A

United States Patent [19]

Hays

[11] Patent Number: 5,147,012

[45] Date of Patent: Sep. 15, 1992

[54] DISCHARGE SILENCING APPARATUS

[75] Inventor: David R. Hays, Connersville, Ind.

[73] Assignee: Dresser Industries, Inc., Dallas, Tex.

[21] Appl. No.: 570,580

[22] Filed: Aug. 21, 1990

[51] Int. Cl.[5] ..... F01N 5/00; F01N 5/02

[52] U.S. Cl. ..... 181/211; 181/229; 55/276

[58] Field of Search ..... 181/211, 212, 200, 224, 181/229; 55/276, 473

[56] References Cited

U.S. PATENT DOCUMENTS

| | | | |
|---|---|---|---|
| 1,591,522 | 7/1926 | French . | |
| 3,646,729 | 3/1972 | McKechnie | 55/473 |
| 3,676,012 | 7/1972 | Brockie . | |
| 3,680,974 | 8/1972 | Smith | 415/54 |
| 4,152,095 | 5/1979 | McKelvey | 415/119 |
| 4,234,325 | 11/1980 | Rea | 55/276 X |
| 4,279,326 | 7/1981 | Meineke et al. | 181/228 |
| 4,412,781 | 11/1983 | Abe et al. | 415/119 X |

*Primary Examiner*—Brian W. Brown
*Assistant Examiner*—Khanh Dang
*Attorney, Agent, or Firm*—Johnson & Gibbs

[57] ABSTRACT

A discharge silencing apparatus having a noise abating device, a housing enclosure for the device and an integral frame for supporting a blower and accompanying motor. The frame provides support for the blower and provides sealing ends for the enclosure to insure outflow of air through the noise abating device to an outlet of the enclosure.

6 Claims, 1 Drawing Sheet

DISCHARGE SILENCING APPARATUS

FIELD OF INVENTION

This invention relates to an apparatus for reducing noise from the discharge of a blower, and more particularly to a discharge silencing apparatus as a mounting base for the blower.

BACKGROUND OF THE INVENTION

There are a variety of discharge silencers that reduce the volume of sound usually produced by the outflow of air through a blower. One such prior art device provides noise abatement, as well as a frame on which to mount the blower and accompanying motor. This prior art device requires the frame be built around the completely assembled, fully functional discharge silencer unit.

Generally, two pieces of flat steel plate have holes cut out in the shape of the cross section of a silencer unit. Each flat plate receives the end portions of the discharge silencer unit and are then welded to the silencer unit. Each plate has a foot that extends outwardly away from the other plate and a platform mounted across the top of each steel plate to provide support for the blower and motor.

The silencer unit includes a double shell construction cylinder for housing noise abating equipment and a pair of dished ends welded to the open ends of the cylinder to provide an airtight seal. Generally, an inlet port is positioned atop the cylinder to communicate with the blower mounted on the platform. On one end, a discharge outlet is in communication with the interior of the cylinder.

The above prior art device requires several welding operations to be fully functional and operational. This assembly requires a number of production operations that incorporates more material and more labor, and accordingly has a higher associated cost.

SUMMARY OF THE INVENTION

It is an object of this invention to provide an apparatus for silencing discharge noise of a blower while providing a supporting structure on which to mount a blower and accompanying motor.

It is a feature of this invention to have a discharge silencing apparatus that includes a mounting bedplate secured to an integral supporting structure and housing for a noise abating device.

It is an advantage of this invention that when the apparatus is completely assembled, there are fewer welds from which leaks may occur, and that this invention is of relatively simple and economical design and manufacture.

A discharge silencing apparatus in accordance with the present invention includes a first and second end plate axially spaced apart, each plate having an integral foot portion to support the apparatus. An intermediate housing or enclosure for a noise abating device having openings on a first and second end is positioned between the end plates and welded airtight. A bedplate platform on which the blower and accompanying motor are mounted, is welded to the upper edge of each end plate and opposite the foot portions. In accordance with one important aspect of the invention, the enclosure for the noise abating device is an integral part of the supporting structure of the blower and motor. An important advantage is that, there are fewer welds required, less material needed, and a more efficient assembly of the apparatus.

Other objects and features of the invention will be apparent in the following description and claims in which the invention is described, together with details to enable persons skilled in the art to practice the invention, all in connection with the best mode presently contemplated for the invention.

BRIEF DESCRIPTION OF THE DRAWINGS

Drawings accompanying the disclosure, and the various views thereof may be briefly described as.

DETAILED DESCRIPTION OF THE INVENTION

Figure 1:
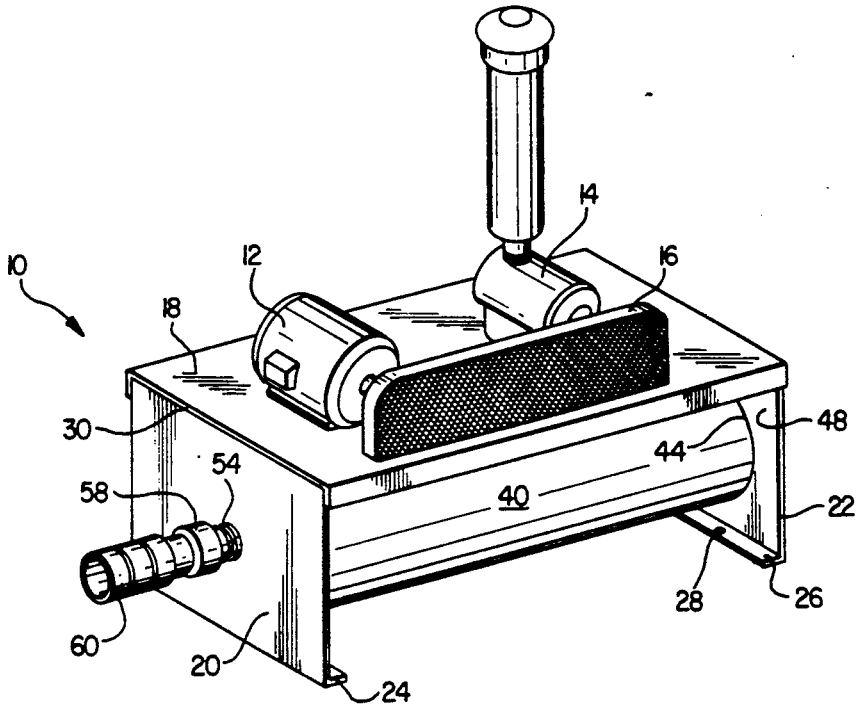
FIG. 1 is a perspective view of a discharge silencing apparatus having a blower and motor mounted thereon.

Referring in more detail to the drawings, FIG. 1 illustrates a discharge silencing apparatus 10 that has mounted on its top portion a motor 12, a blower 14, a belt guard 16 and a drive belt (not shown). The noise produced by the out-flow of air through blower 14 is attenuated by the discharge silencing apparatus 10.

Figure 4:
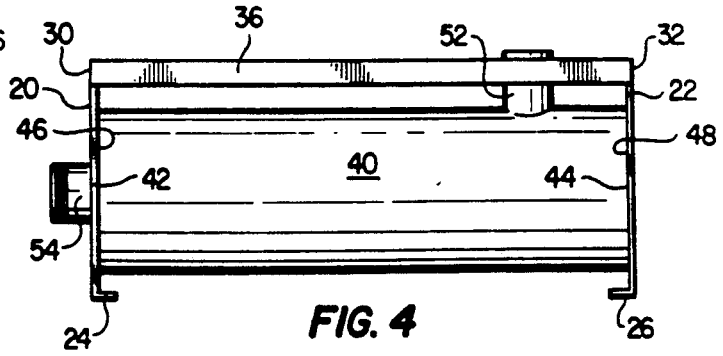
FIG. 4 is a side elevational view of the discharge silencing apparatus.

As shown in FIGS. 1 and 4, the discharge silencing apparatus 10 includes a supporting structure having a bedplate platform 18 positioned over a pair of end plates 20, 22 that are axially spaced apart from each other. Each end plate 20, 22 is generally flat and made of a high strength material such as steel. A foot portion 24, 26 is integral to and at right angles with the bottom portion of plates 20, 22, respectively. Preferably each foot portion 24, 26 extends inwardly from the end plates 20, 22 so that each plate 20, 22 and foot portion 24, 26 are in mirror symmetrical relationship (see FIG. 4). Each foot portion 24, 26 may have at least one bore 28, so that supporting structure may be fastened down to the floor or a machine.

Figure 2:
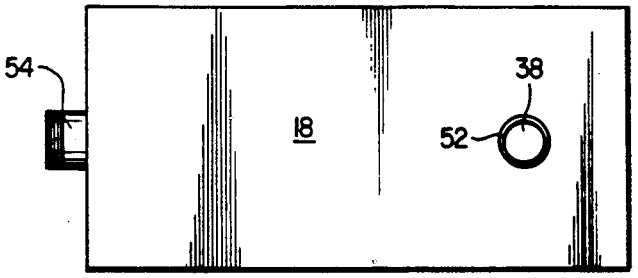
FIG. 2 is a top view of the discharge silencing apparatus.
Figure 3:
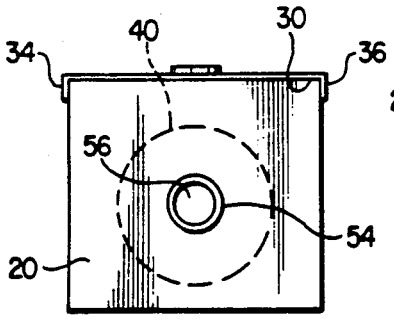
FIG. 3 is an end view of the discharge silencing apparatus.

The bedplate 18 is secured to the upper edges 30, 32 of end plates 20, 22 and is made of high strength, rigid material such as steel. As shown in FIG. 3, the bedplate 18 has downwardly extending edges 34, 36 to provide added strength and stiffness to the support structure. As shown in FIG. 2, the bedplate 18 also includes an inlet opening 38 for the discharge of the blower 14.

An intermediate housing or enclosure 40 houses a noise abating device such as a series of baffles and/or an arrangement of ported tubes (not shown). The enclosure 40 is preferably cylindrical in shape and has openings at opposite ends 42, 44 that are fixedly attached to the inside face 46, 48 of plates 20, 22. An inlet conduit 52 is positioned atop enclosure 40 to communicate the inlet opening 38 of bedplate 18 with the noise abating device within enclosure 40.

As shown in FIG. 4, an outlet conduit 54 is received through an opening 56 to communicate with the interior of enclosure 40. As shown in FIG. 1, outlet conduit 54 may be connected to a check valve 58 and/or a hose connector 60.

This construction of the discharge silencing apparatus 10 can support and hold a blower 14 and its accompanying drive motor 12. The assembly requires that the blower 14 be positioned over inlet 38 and have a blower outlet coupled to conduit 52, so that air may be contained by and discharged through conduit 52 into enclosure 40, through the noise abating device located within and expelled out outlet conduit 54. Then the blower 14 and motor 12 is detachably mounted to this position on top of bedplate 18 to insure that the outflow of air is directed through enclosure 40.

For added stability, the discharge silencing apparatus 10 may be mounted or secured to a floor or a machine by placing lag bolts or anchor bolts through openings 28 in the foot portion 24, 26. As can be seen in FIG. 1, the turned in foot portions 24, 26 of the discharge silencing apparatus 10 reduces the chance of bolts being bumped into, hit or damaged, because of the overhead protection from the enclosure 40.

The above detailed description clearly describes an invention that is of a relatively simple and economical design. The manufacture of such invention requires less material, less labor and far less expense.

It is also to be understood that the terminology as employed in the description and claims incorporated herein is used by way of description and not by way of limitation, to facilitate understanding of the structure, function and operation of the combination of elements which constitute the present invention. Moreover, while the foregoing description and drawings illustrate in detail one successful working embodiment of the invention, to those skilled in the art to which the present invention relates, the present disclosure will suggest many modifications in the construction, as well as widely differing embodiments and applications without thereby departing from the spirit and scope of the invention. The present invention, therefore, is intended to be limited only by the scope of the appended claims and applicable prior art.

What is claimed is:

1. A blower and blower motor mounting base and housing for a blower discharge silencing apparatus comprising:

a. first and second vertical end support plates in substantially parallel spaced apart relation, each of said support plates having a bottom edge flange extending the full length of each plate defining a mounting foot on each support plate bottom edge for mounting said apparatus on a supporting surface;

b. a bedplate secured along opposite ends to top edges of said first and second end support plates, said bedplate including integral downwardly turned opposite side edge flanges secured at opposite ends to upper side edge portions of said end support plates, said bedplate providing a supporting surface for a blower and a blower drive motor, said bedplate having an opening therein for a discharge conduit from a blower positioned near a first end of said bedplate and a first of said end support plates;

c. a housing for blower discharge silencing apparatus mounted between said end support plates extending between inside faces of said end support plates and spaced below said bedplate;

d. a blower discharge conduit connected at a lower end into a top portion of said housing for said blower discharge apparatus and extending upwardly therefrom through said opening in said bedplate for connection with a discharge from a blower mounted on said bedplate; and e. a housing discharge conduit connected with the outside face of said second of said end support plates opening through said support plate into said housing.

2. A blower and blower motor mounting base and housing for a blower discharge silencing apparatus in accordance with claim 1 wherein said flanges along said bottom edges of said end support plates extend perpendicular to and inwardly from said end support plates toward each other.

3. A blower and blower motor mounting base and housing for a blower discharge silencing apparatus in accordance with claim 2 wherein said end support plates and said bedplates are rectangular.

4. A blower and blower motor mounting base and housing for a blower discharge silencing apparatus in accordance with claim 3 wherein said housing is cylindrical in shape.

5. A blower and blower motor mounting base and housing for a blower discharge silencing apparatus in accordance with claim 4 wherein said end support plate mounting feet are provided with openings for bolts to secure said feet to a supporting surface member.

6. A blower and blower motor mounting base and housing for a blower discharge silencing apparatus in accordance with claim 5 including a check valve connected with said conduit into said second end plate and a hose connector connected with said check valve.

* * * * *